US008317082B2

(12) United States Patent
May et al.

(10) Patent No.: US 8,317,082 B2
(45) Date of Patent: Nov. 27, 2012

(54) CARTON WITH LOCKING SECTIONS

(75) Inventors: Kevin T. May, Kennesaw, GA (US); Kirsten L. Brand, Marietta, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 412 days.

(21) Appl. No.: 12/565,508

(22) Filed: Sep. 23, 2009

(65) Prior Publication Data

US 2010/0072267 A1 Mar. 25, 2010

Related U.S. Application Data

(60) Provisional application No. 61/194,069, filed on Sep. 24, 2008.

(51) Int. Cl.
*B65D 5/42* (2006.01)
*B65D 7/20* (2006.01)

(52) U.S. Cl. ..... 229/128; 206/139; 53/484

(58) Field of Classification Search ..... 229/128, 229/198.2; 53/484; 206/140, 139
See application file for complete search history.

(56) References Cited

U.S. PATENT DOCUMENTS

| | | | |
|---|---|---|---|
| 2,849,111 | A | 8/1958 | Fielding |
| RE24,667 | E | 7/1959 | Fielding |
| 2,922,561 | A | 1/1960 | Currivan |
| 2,928,541 | A | 3/1960 | Fielding |
| 2,929,497 | A | 3/1960 | De Million-Czarnecki |
| 3,178,242 | A | 4/1965 | Ellis |
| 3,237,762 | A | 3/1966 | Wood |
| 3,252,649 | A | 5/1966 | Graser et al. |
| 3,300,115 | A | 1/1967 | Schauer |
| 3,306,519 | A | 2/1967 | Wood |
| 3,339,723 | A | 9/1967 | Wood |
| 3,343,660 | A | 9/1967 | Bailey |
| 3,356,279 | A | 12/1967 | Root |
| 3,373,867 | A | 3/1968 | Wood |

(Continued)

FOREIGN PATENT DOCUMENTS

| | | |
|---|---|---|
| BE | 671.762 | 3/1996 |

(Continued)

OTHER PUBLICATIONS

International Search Report and Written Opinion—PCT/US2009/057990, mailed Feb. 22, 2010.

(Continued)

*Primary Examiner* — Nathan J Newhouse
*Assistant Examiner* — Christopher Demeree
(74) *Attorney, Agent, or Firm* — Womble Carlyle Sandridge & Rice, LLP

(57) ABSTRACT

A carton with locking sections comprises a male panel section and a female panel section. The male panel section has an edge with protruding wings, and edge tabs are formed along the edge portion inboard of the wings. The female section has a pair of females configured to receive and interlock with the males. For locking the sections together, the edge tabs are hooked beneath the edge of the female section and the males extend over the top of the female section and are pressed and locked into the females. With this arrangement, the two sections are securely locked together with the edge tabs preventing the sections from moving toward one another and the males and females preventing them moving away from each other. The sections thus do not tend to disengage during transport or as containers of product within the carton are sequentially removed.

39 Claims, 9 Drawing Sheets

U.S. PATENT DOCUMENTS

| | | | | | |
|---|---|---|---|---|---|
| 3,429,496 | A | | 2/1969 | Hickin | |
| 3,447,672 | A | | 6/1969 | Bailey | |
| 3,517,858 | A | | 6/1970 | Farquhar | |
| 3,593,849 | A | | 7/1971 | Helms | |
| 3,635,452 | A | | 1/1972 | Helms | |
| 3,669,342 | A | | 6/1972 | Funkhouser | |
| 3,669,343 | A | | 6/1972 | Howard | |
| 3,747,835 | A | | 7/1973 | Graser | |
| 3,767,042 | A | * | 10/1973 | Ganz | 206/197 |
| 3,963,121 | A | | 6/1976 | Kipp | |
| 4,004,500 | A | | 1/1977 | Wood | |
| 4,010,593 | A | | 3/1977 | Graham | |
| 4,096,985 | A | | 6/1978 | Wood | |
| 4,101,069 | A | | 7/1978 | Wood | |
| 4,200,220 | A | * | 4/1980 | Ganz | 206/140 |
| 4,202,446 | A | | 5/1980 | Sutherland | |
| 4,328,893 | A | | 5/1982 | Oliff et al. | |
| 4,394,903 | A | | 7/1983 | Bakx | |
| 4,421,232 | A | | 12/1983 | Konaka | |
| 4,424,901 | A | | 1/1984 | Lanier | |
| 4,440,340 | A | | 4/1984 | Bakx | |
| 4,566,593 | A | | 1/1986 | Muller | |
| 4,747,487 | A | | 5/1988 | Wood | |
| 4,784,266 | A | | 11/1988 | Chaussadas | |
| 4,804,089 | A | | 2/1989 | Wilson | |
| 4,860,943 | A | | 8/1989 | Cooper | |
| 4,875,585 | A | | 10/1989 | Kadleck et al. | |
| 4,901,849 | A | | 2/1990 | Wilson | |
| 4,919,266 | A | | 4/1990 | McIntosh, Jr. et al. | |
| 4,966,324 | A | | 10/1990 | Steel | |
| 4,972,991 | A | | 11/1990 | Schuster | |
| 5,000,313 | A | | 3/1991 | Oliff | |
| 5,042,660 | A | | 8/1991 | Carver | |
| 5,060,792 | A | | 10/1991 | Oliff | |
| 5,131,588 | A | | 7/1992 | Oliff | |
| 5,180,100 | A | * | 1/1993 | Shimizu | 229/198.2 |
| 5,195,676 | A | | 3/1993 | LeBras | |
| 5,246,112 | A | | 9/1993 | Stout et al. | |
| 5,297,673 | A | | 3/1994 | Sutherland | |
| 5,351,878 | A | | 10/1994 | Cooper | |
| 5,395,043 | A | | 3/1995 | Bacques et al. | |
| 5,421,458 | A | | 6/1995 | Campbell | |
| 5,443,203 | A | | 8/1995 | Sutherland | |
| 5,472,090 | A | | 12/1995 | Sutherland | |
| 5,472,138 | A | | 12/1995 | Ingram | |
| 5,485,915 | A | | 1/1996 | Harris | |
| 5,505,372 | A | | 4/1996 | Edson et al. | |
| 5,542,536 | A | * | 8/1996 | Sutherland | 206/427 |
| 5,551,556 | A | | 9/1996 | Sutherland | |
| 5,558,212 | A | | 9/1996 | Sutherland | |
| 5,558,213 | A | | 9/1996 | Sutherland | |
| 5,597,071 | A | | 1/1997 | Sutherland | |
| 5,609,251 | A | | 3/1997 | Harris | |
| 5,664,401 | A | | 9/1997 | Portrait et al. | |
| 5,682,995 | A | | 11/1997 | Sutherland | |
| 5,692,614 | A | | 12/1997 | Harris | |
| 5,704,542 | A | | 1/1998 | Harrelson | |
| 5,778,630 | A | | 7/1998 | Portrait et al. | |
| 5,782,343 | A | | 7/1998 | Harrelson | |
| 5,853,088 | A | | 12/1998 | Saulas et al. | |
| 5,855,318 | A | | 1/1999 | Baxter | |
| 5,931,300 | A | | 8/1999 | Sutherland | |
| 5,937,620 | A | | 8/1999 | Chalendar | |
| 5,941,453 | A | | 8/1999 | Oliff | |
| 5,943,847 | A | | 8/1999 | Chalendar | |
| 5,947,367 | A | | 9/1999 | Miller et al. | |
| 5,975,286 | A | | 11/1999 | Oliff | |
| 6,019,220 | A | | 2/2000 | Sutherland | |
| 6,021,898 | A | | 2/2000 | Sutherland | |
| 6,021,899 | A | | 2/2000 | Sutherland | |
| 6,085,969 | A | | 7/2000 | Burgoyne | |
| 6,109,438 | A | | 8/2000 | Sutherland | |
| 6,155,480 | A | | 12/2000 | Botsford et al. | |
| 6,158,586 | A | | 12/2000 | Muller | |
| 6,227,367 | B1 | | 5/2001 | Harrelson et al. | |
| 6,283,293 | B1 | | 9/2001 | Lingamfelter | |
| 6,289,651 | B1 | * | 9/2001 | Le Bras | 53/394 |
| 6,315,123 | B1 | | 11/2001 | Ikeda | |
| 6,378,697 | B1 | | 4/2002 | Sutherland et al. | |
| 6,378,765 | B1 | | 4/2002 | Sutherland | |
| 6,550,616 | B2 | | 4/2003 | Le Bras | |
| 6,789,673 | B2 | | 9/2004 | Lingamfelter | |
| 6,811,525 | B2 | | 11/2004 | Culpepper | |
| 6,866,185 | B2 | | 3/2005 | Harrelson | |
| 6,946,651 | B1 | | 9/2005 | Bohne | |
| 6,948,651 | B2 | | 9/2005 | Ikeda | |
| 6,981,631 | B2 | | 1/2006 | Fogle et al. | |
| 6,988,617 | B2 | | 1/2006 | Gomes et al. | |
| 7,007,800 | B2 | | 3/2006 | LeBras | |
| 7,025,197 | B2 | | 4/2006 | Sutherland | |
| 7,159,759 | B2 | | 1/2007 | Sutherland | |
| 7,175,020 | B2 | | 2/2007 | Sutherland et al. | |
| 7,427,010 | B2 | | 9/2008 | Sutherland | |
| 7,448,492 | B2 | | 11/2008 | Sutherland | |
| 7,644,817 | B2 | | 1/2010 | Sutherland | |
| 7,677,387 | B2 | | 3/2010 | Brand et al. | |
| 7,762,395 | B2 | | 7/2010 | Sutherland et al. | |
| 7,762,397 | B2 | | 7/2010 | Coltri-Johnson et al. | |
| 2003/0000182 | A1 | | 1/2003 | Portrait et al. | |
| 2003/0132130 | A1 | | 7/2003 | Le Bras | |
| 2004/0000582 | A1 | | 1/2004 | Sutherland | |
| 2004/0011674 | A1 | | 1/2004 | Theelen | |
| 2004/0069659 | A1 | | 4/2004 | Sutherland | |
| 2004/0089671 | A1 | | 5/2004 | Miller | |
| 2004/0188277 | A1 | | 9/2004 | Auclair | |
| 2004/0188301 | A1 | | 9/2004 | Gomes | |
| 2004/0243277 | A1 | | 12/2004 | Bonnain et al. | |
| 2004/0254666 | A1 | | 12/2004 | Bonnain et al. | |
| 2005/0001020 | A1 | | 1/2005 | Gamier | |
| 2005/0103652 | A1 | | 5/2005 | Wilkins | |
| 2005/0167290 | A1 | | 8/2005 | Sutherland | |
| 2005/0178791 | A1 | | 8/2005 | Miller | |
| 2005/0194430 | A1 | | 9/2005 | Auclair et al. | |
| 2006/0157545 | A1 | | 7/2006 | Auclair | |
| 2006/0191811 | A1 | | 8/2006 | Fogle et al. | |
| 2006/0255108 | A1 | | 11/2006 | Shmagin | |
| 2007/0017829 | A1 | | 1/2007 | Sutherland | |
| 2007/0241017 | A1 | | 10/2007 | Sutherland et al. | |
| 2010/0072267 | A1 | | 3/2010 | May | |

FOREIGN PATENT DOCUMENTS

| | | | |
|---|---|---|---|
| CA | 2542350 | | 5/2005 |
| DE | 91 04 905.9 | | 6/1991 |
| DE | 92 03 858.1 | | 5/1992 |
| EP | 0 459 658 | A1 | 12/1991 |
| EP | 0 509 749 | A1 | 10/1992 |
| EP | 0520 411 | A1 | 12/1992 |
| FR | 2 698 074 | | 5/1994 |
| JP | 41-18199 | | 10/1941 |
| JP | 5-112373 | | 5/1993 |
| JP | 2003252323 | | 9/2003 |
| WO | WO 97/27124 | | 7/1997 |
| WO | WO 00/78634 | A1 | 12/2000 |
| WO | WO 02/102208 | A1 | 12/2002 |
| WO | WO 03/008292 | A2 | 1/2003 |
| WO | WO 2004/087507 | A2 | 10/2004 |
| WO | WO 2005/092735 | A2 | 10/2005 |
| WO | WO 2005/042370 | A1 | 12/2005 |
| WO | WO 2007/126977 | A2 | 11/2007 |
| WO | WO 2009/015320 | A2 | 1/2009 |

OTHER PUBLICATIONS

Office Action for CA 2,737,657, dated Jan. 9, 2012.

Office Action for CA 2,738,060, dated Feb. 6, 2012.

Supplementary European Search Report for EP 09 81 6780 dated Jan. 17, 2012.

* cited by examiner

CARTON WITH LOCKING SECTIONS

CROSS-REFERENCE TO RELATED APPLICATIONS

This application claims the benefit of U.S. Provisional Application No. 61/194,069, filed on Sep. 24, 2008, the entire disclosure of which is incorporated herein by reference.

TECHNICAL FIELD

This disclosure relates generally to cartons and more particularly to paperboard cartons for containing articles such as juice and beverage bottles.

BACKGROUND

Paperboard cartons for containing and carrying articles such as beverage cans and juice bottles are well known. In the case of paperboard cartons for articles such as juice bottles, it is common for the paperboard to wrap around the bottles and interlock with locking sections on the bottom to confine the bottles in their group, allow them to be carried by a user, and facilitate easy removal through the open ends of the carton. Prior art locking sections of these types of paperboard cartons have exhibited certain problems, among which is their tendency to disengage particularly when one or more bottles is removed from the carton. Accordingly, there exists a need for a paperboard carton with locking sections that increase sustainability of engagement between the locking sections.

SUMMARY

The disclosure relates to a carton with locking sections and a method for closing locking sections of a carton.

According to an embodiment, a carton comprises a first side panel, a second side panel, a first bottom panel foldably connected to the first side panel, and a second bottom panel foldably connected to the second side panel. The first bottom panel can include at least one male locking member protruding from an edge of the first bottom panel, and at least one tab positioned inboard of the at least one male locking member. The second side panel can include at least one female locking member. The at least one female locking member can be configured to receive and interlock with the at least one male locking member, and the at least one tab can be configured to be hooked beneath an edge of the second bottom panel.

The interlocking engagement of the at least one female locking member and the at least one male locking member can tend to prevent the first and second bottom panels from being moved away from each other. The hooking of the at least one tab beneath the edge of the second bottom panel can tend to prevent the first and second bottom panels from being moved towards each other. Thus, the first and second bottom panels can be locked together such that the carton is held securely together.

According to an embodiment, a method for closing a bottom of a carton can comprise providing a first bottom panel comprising at least one male locking member protruding from an edge of the first bottom panel, and at least one tab positioned inboard of the at least one male locking member, and providing a second bottom panel comprising at least one female locking member. The method can further comprise moving an edge of the first bottom panel towards an edge of the second bottom panel, inserting at the least one male locking member into the at least one female locking member, interlocking the at least one female locking member with the at least one male locking member, and hooking the at least one tab beneath an edge of the second bottom panel.

Those skilled in the art will appreciate the above features and advantages, as well as additional features and advantages upon reading the following detailed description with reference to the accompanying drawings.

DISCLOSURE

Figure 1:
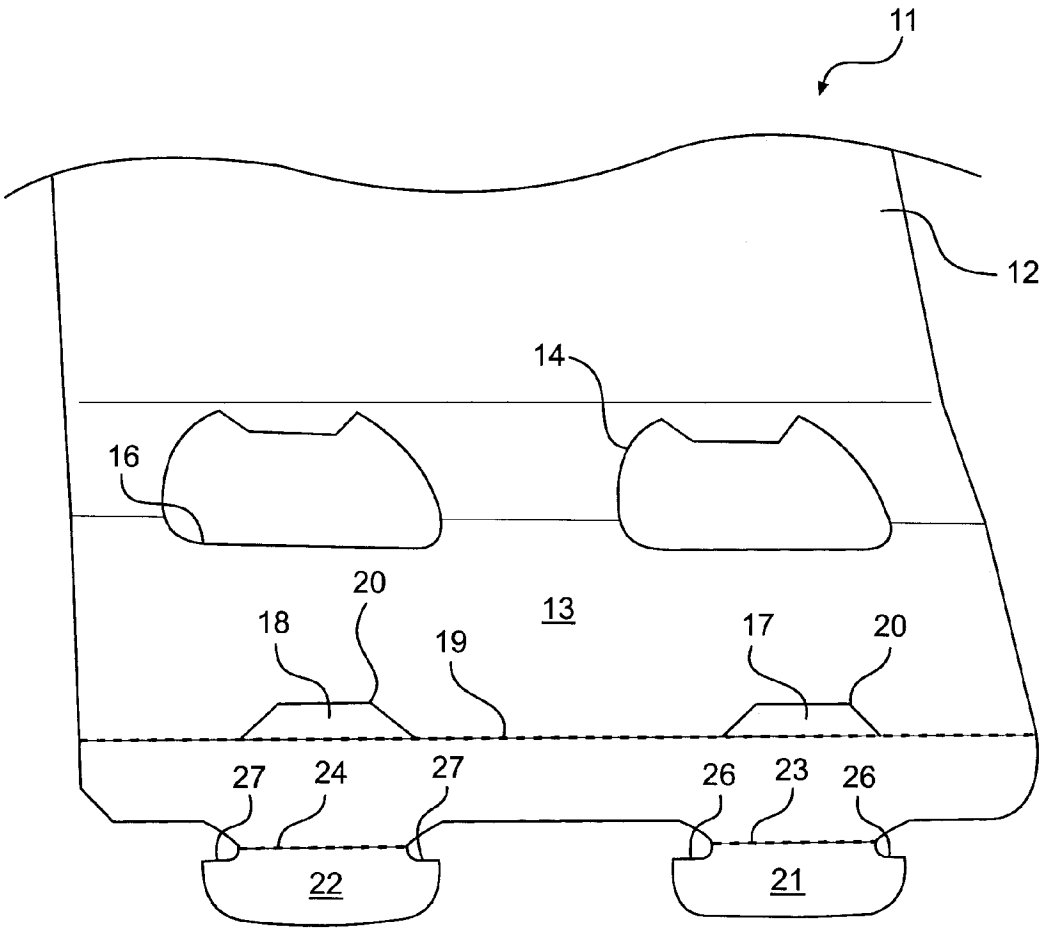
FIG. 1 PRIOR ART
FIGS. 1 and 2 illustrate a prior art paperboard carton including locking sections.
Figure 2:
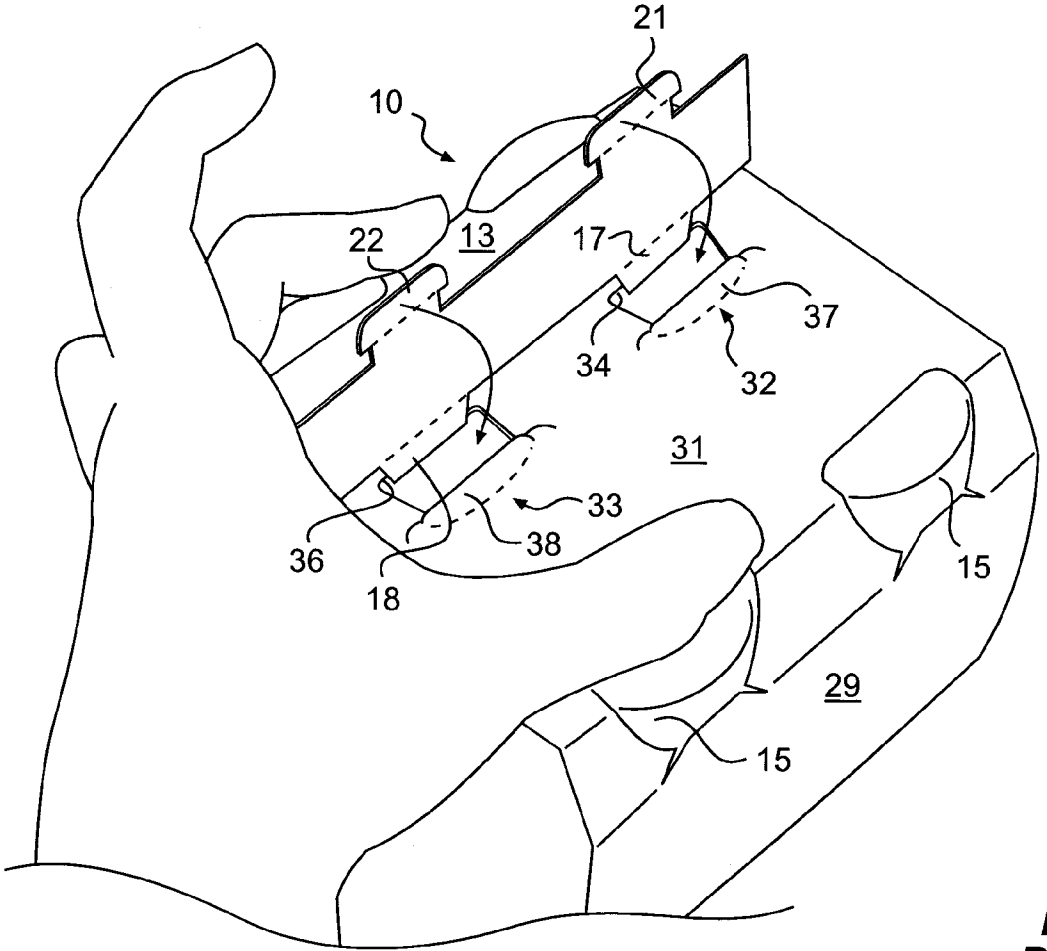
FIG. 2 PRIOR ART

FIGS. 1 and 2 illustrate a typical prior art paperboard carton of the type that has locking sections. Referring first to FIG. 2, the carton 10 is seen to wrap around a grouping of bottles 15 (shown upside-down in FIG. 2). The ends or bottom panels of the carton blank meet on the bottom of the package and interlock together to secure the carton around the bottles. More specifically, male panel 13 meets and overlaps female panel 31 and interlocks therewith. For this purpose, female panel 31 is provided with locking features 32 and 33 comprising spaced-apart cutouts. Each locking feature 32 and 33 has an open cutout portion that defines hook edges 34 and 36 respectively. Secondary female locking elements, or "females" 37 and 38 are formed along one side of the cutouts opposite to the hook edges 34 and 36.

As perhaps best illustrated in FIG. 1, the opposing male panel 13 is provided with features that interlock with the locking features of the female panel 31. More specifically, male panel 13 is cut and scored to define product positioning openings 14 and 16, which embrace the bottoms of bottles to hold them in place within the carton (FIG. 2). Primary male locking elements, or "primary males" 17 and 18 are formed in the edge portion of the bottom panel 13 by through-scores 20. Cut crease 19 is formed along the edge portion of the panel 13 and intersects the bases of primary males 17 and 18 as shown. Along the edge of the bottom panel 13 opposing primary males 17 and 18 are secondary male locking elements, or "secondary males" 21 and 22, which join the edge of the panel 13 along crease or fold lines 23 and 24 respectively. Secondary male 21 is shaped to define shoulders 26 and, similarly, secondary male 22 defines shoulders 27, as illustrated in FIG. 1. To lock these prior art sections together (FIG. 2) the male panel 13 is positioned to overlap the female panel 31. The primary males 17 and 18 are first hooked over the hook edges 34 and 36 of the cutouts as shown. The secondary males 21 and 22 are then folded downward as indicated by the arrows and tucked beneath the females 31 and 38 until the shoulders 26 and 27 lock the secondary males 21 and 22 in place.

While the above-described system has been common in the prior art, it nevertheless has experienced problems and shortcomings. For example, particularly when one or more bottles are removed from the carton, the carton can become loose and the panels 13 and 31 can become disengaged. This is partially because the panels 13 and 31 can be moved toward each other, which can dislodge the primary males 17 and 18 from the hook edges 34 and 36. It is then an easy matter for the secondary males 21 and 22 to become skewed and dislodged from the females 37 and 38. The invention exemplified by the following disclosure seeks, among other things, to resolve this issue.

Figure 3:
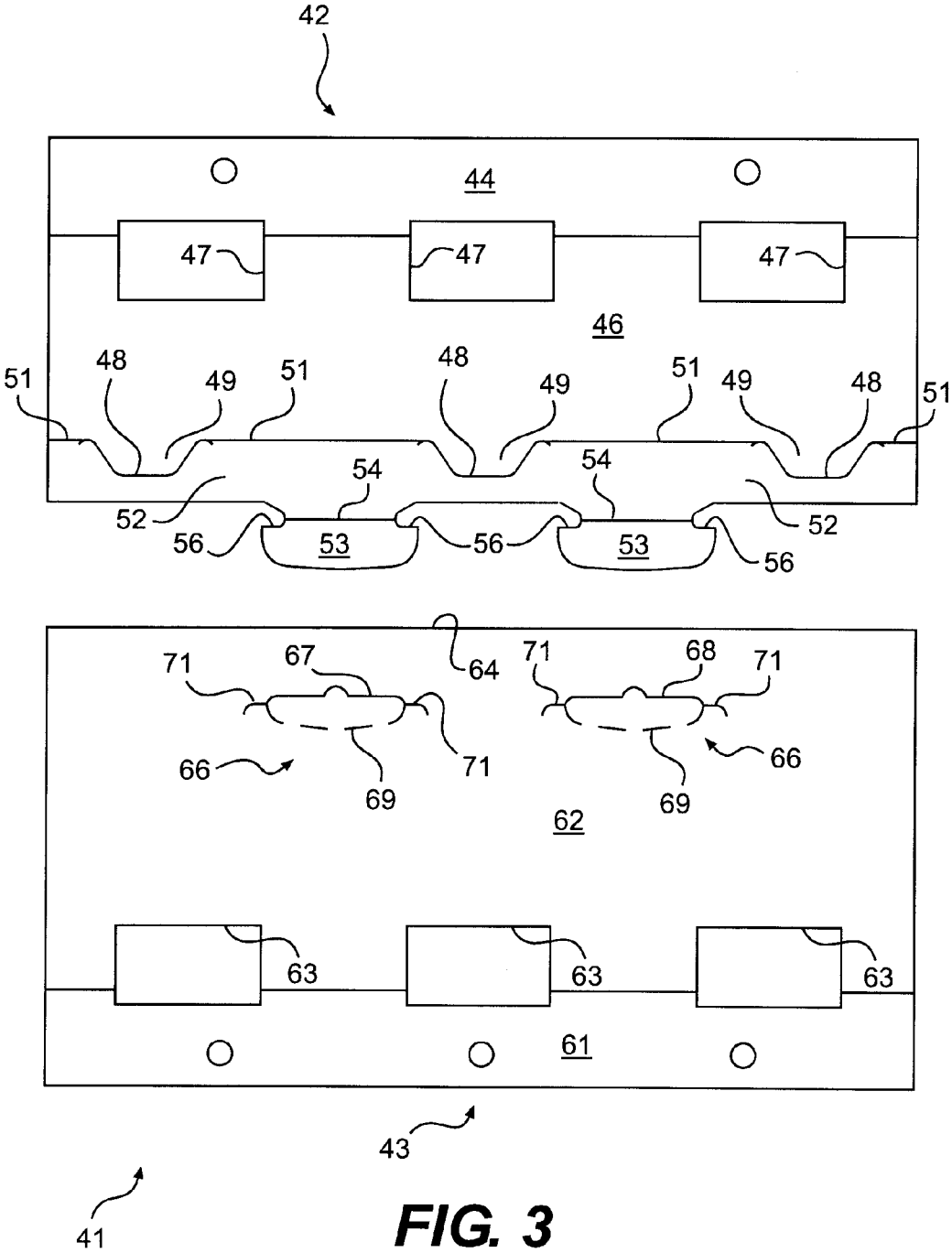
FIG. 3 illustrates locking panels of a carton according to an embodiment of the disclosure.

FIG. 3 illustrates the locking feature of a carton according to the present disclosure, by which a bottom of the carton can be closed and locked. It will be understood that in FIG. 3, only the bottom panels 46 and 62 and a portion of side panels 44 and 61 are illustrated. Bottom panel 46, which may be designated the "male" panel, is foldably connected to the side panel 44 and has cutouts 47 designed to embrace the bottoms of containers such as juice bottles to be contained within the carton. Three edge tabs 49 are defined along an inner edge portion of the male panel 46 by inboard cut lines or through-scores 48, which border the edge tabs 49, and inboard fold lines or cut-creases 51, which extend between the bases of the edge tabs 49. The edge tabs 49 are spaced apart along the width of the male panel 46. A locking panel section 52 of the male panel 46 is foldably attached to the remainder of the male panel 46 at fold lines 51. A pair of male locking elements or wings 53, which may be referred to as "males," is positioned outboard of the tabs 49 and projects from the outer edge of the male panel 46, more particularly, the outer edge of the locking panel section 52, and each male 53 is connected thereto along a fold line or score line 54. Males 53 are offset from the tabs 49 along the width of the male panel 46, as shown. Each of the males 53 is formed to define shoulders 56, as illustrated.

Second bottom panel 62, which may be designated the "female" panel, is foldably connected to the side panel 61 and has cutouts 63 for receiving the bottom edges of beverage bottles within the carton. A pair of female locking elements 66, which may be referred to as "females," is defined in the female panel 62 by cut lines or through-scores 67 and 68 and fold lines or cut-creases 69. Each of the cuts 67 and 68 terminates in slits 71 at its ends as illustrated. The females 66 are spaced apart the same distance as and positioned to align with the males 53 of the male panel 46. Further, each female 66 can hinge or pivot about its fold line 69.

Figure 4:
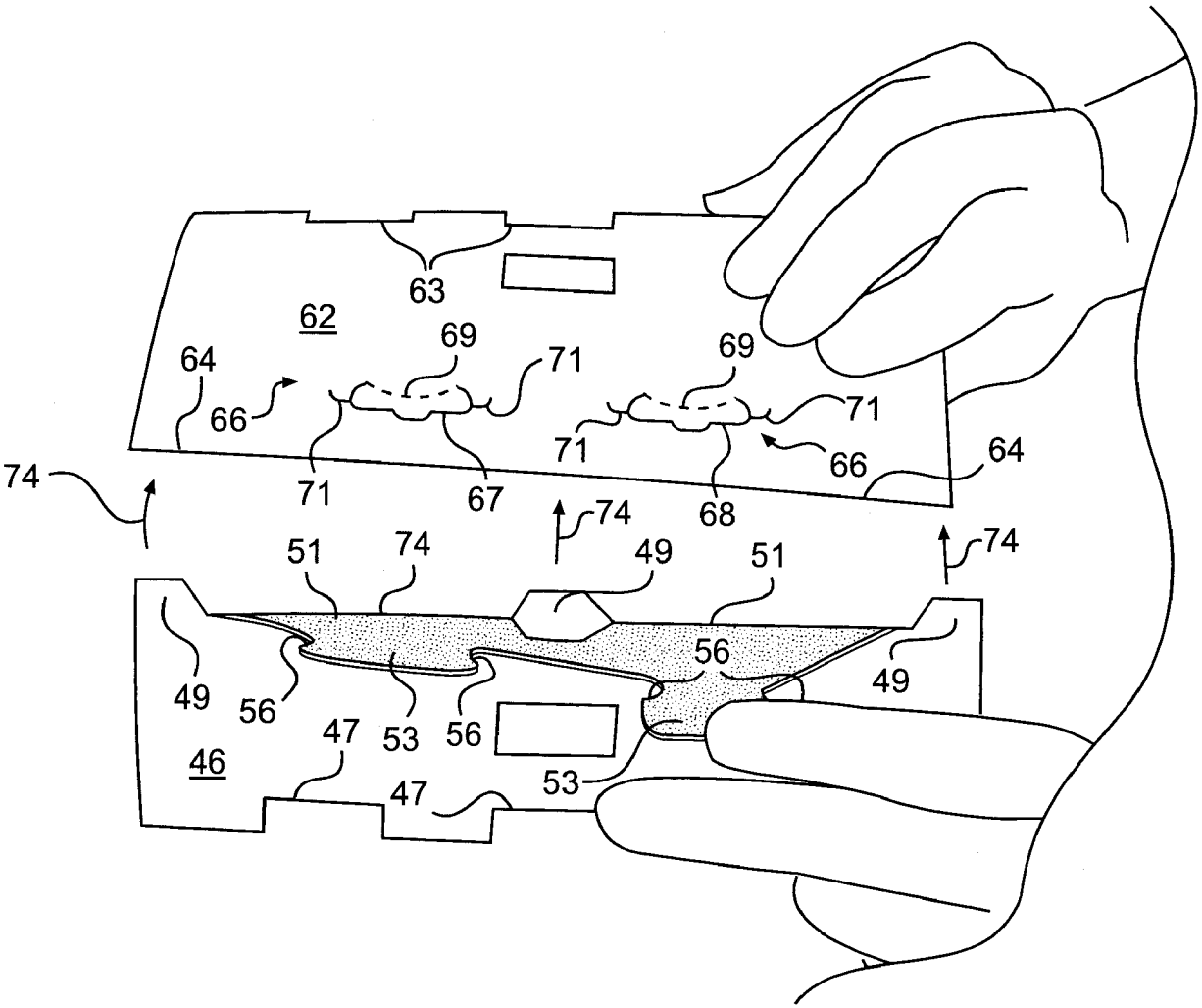
FIGS. 4-6 illustrate a process for interlocking the locking panels of FIG. 3.
Figure 5:
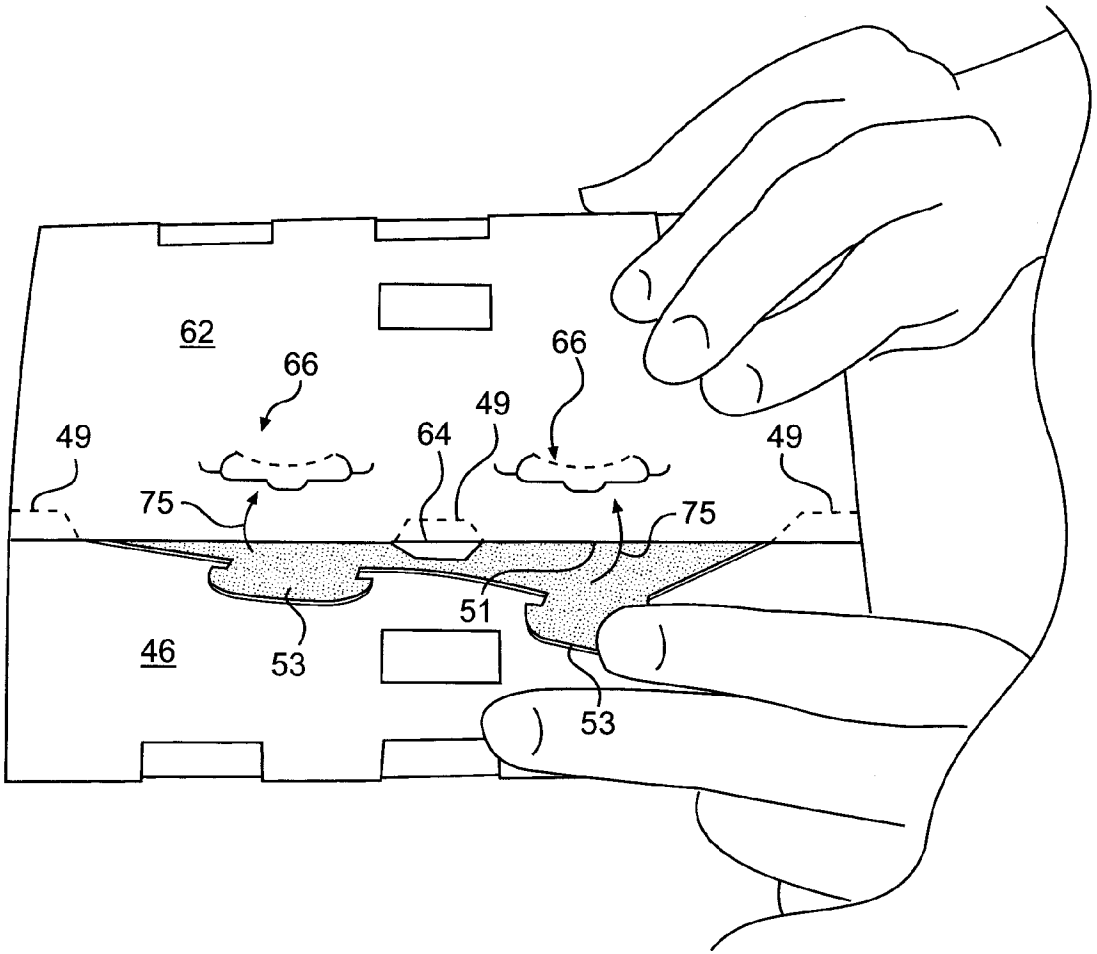
Figure 6:
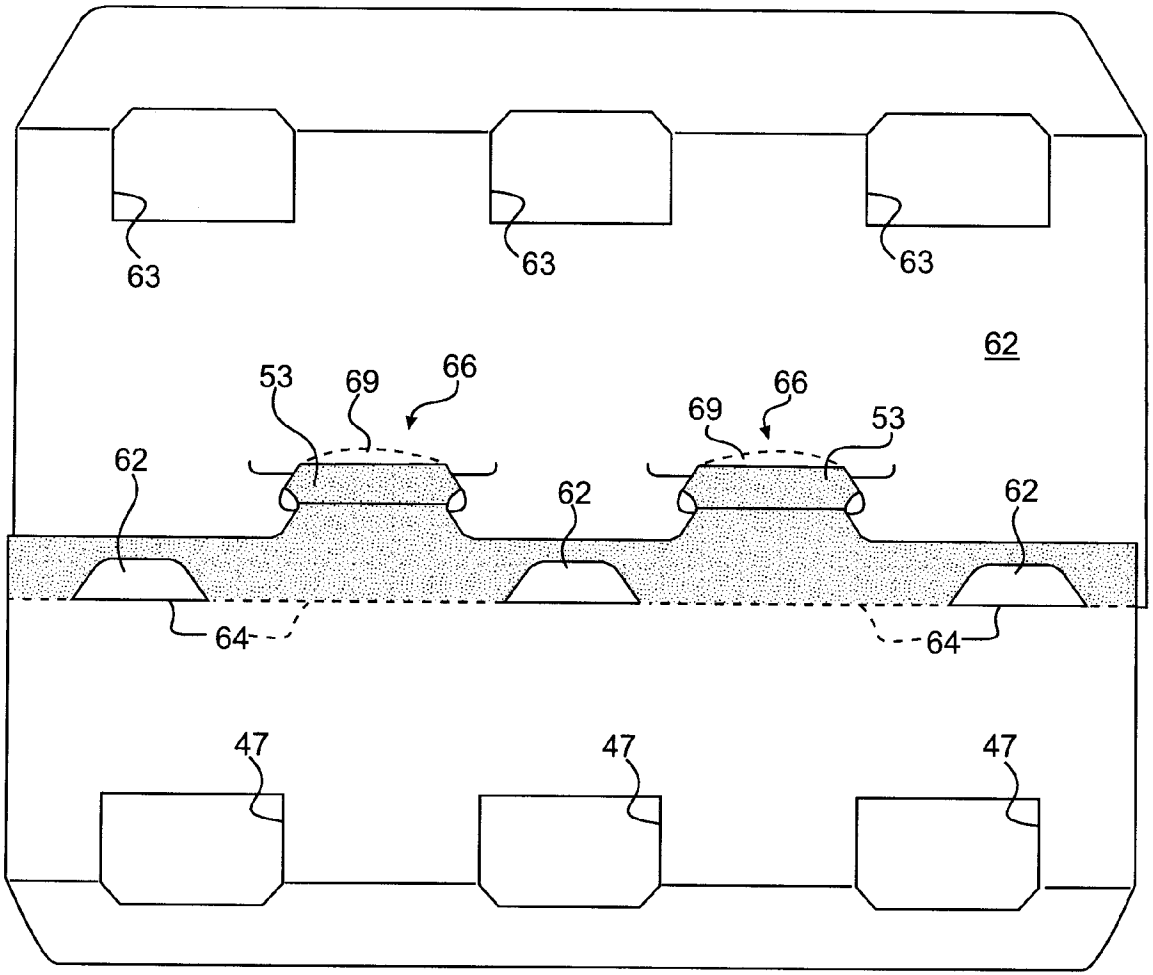

FIGS. 4 through 6 illustrate the method of locking panels 46 and 62 together to close the bottom of the carton according to the present disclosure. First, as illustrated in FIG. 4, the locking panel section 52 in which the males 53 are attached is folded or bent back away from the tabs 49, as shown, along cut-creases 51. Since edge tabs 49 are defined by cut lines 48, they remain substantially coextensive with and project from the male panel 46 toward the edge 64 of female panel 62. The two panels 46 and 62 are then brought together toward one another as illustrated by arrows 74. As the edges of the panels 46 and 62 engage one another, the edge tabs 49 of the male panel 46 slide underneath the edge 64 of female panel 62 until the now folded fold lines 51 engage the edge 64 of the female panel 62, thereby causing the edge tabs 49 to be hooked beneath the female panel 62. This condition is illustrated in FIG. 5, wherein the edge tabs 49 slid and hooked beneath the edge 64 of panel 62 are shown in phantom lines.

Figure 7:
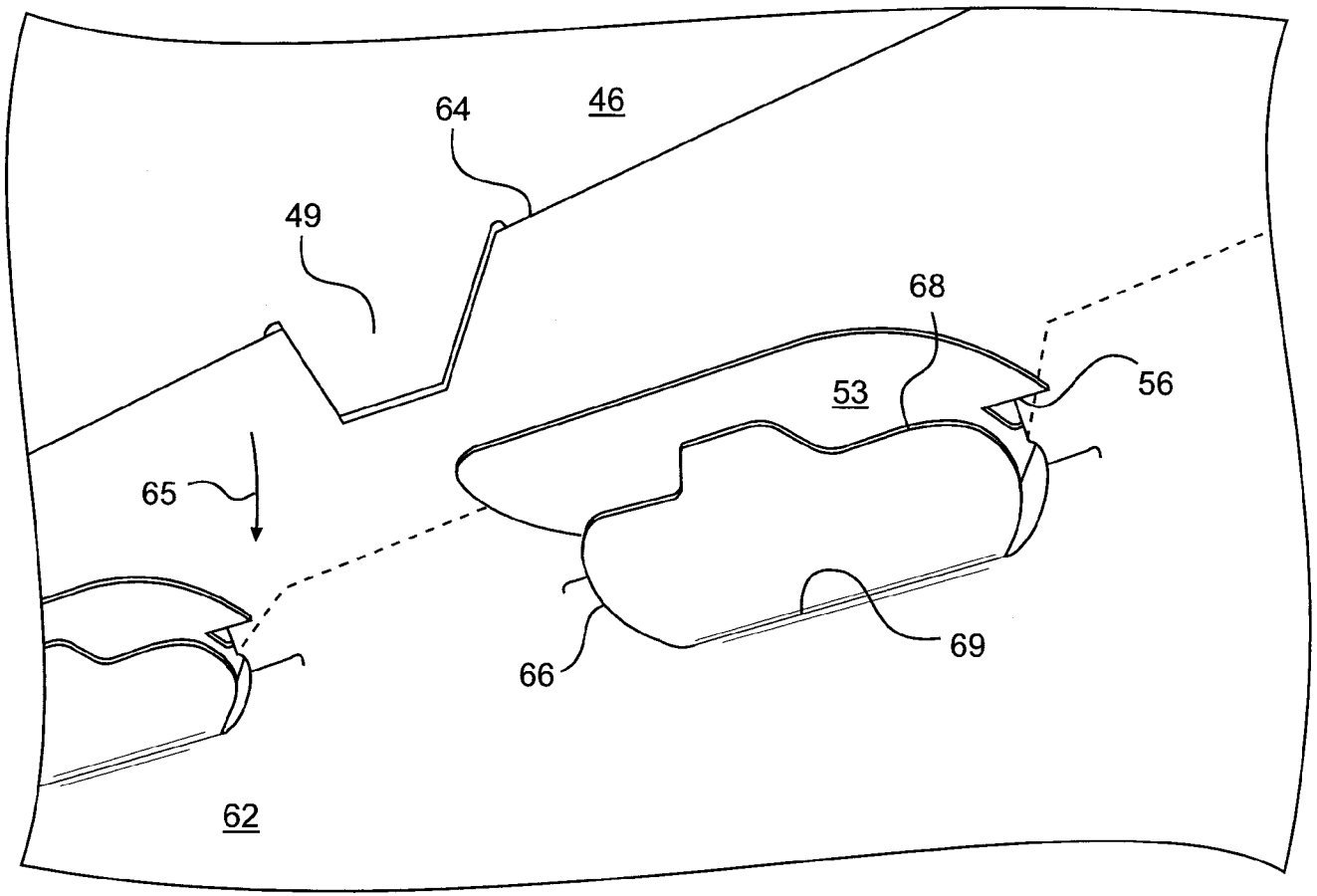
FIG. 7 is a bottom view illustrating locking engagement between the locking panels.

With the edge portions of the panels 62 and 46 brought together as shown in FIG. 5, the males 53 are folded over in the direction of arrow 75 until the locking panel section 52 and the males 53 overlap the bottom panel 62 and the males 53 register with respective ones of the females 66. The males 53 are then pressed through the females 66 as shown in FIG. 6 to lock the panels 46 and 62 together. Pressing the males 53 through the females 66 causes the females 66 to fold inwardly along fold line 69 to accept the wings as shown in FIG. 7. With further reference to FIG. 7, the female 66 is seen to bear against the male 53 to retain the male 53 in its locked position within the female 66. In this position, the shoulders 56 of the male 53 engage the paperboard on either side of the female 66 to secure the male 53 in place and prevent the male 53 from pulling back out of the female 66. FIG. 7 also demonstrates the edge tabs 49 extending beneath the edge 64 of female panel 62. It can thus be seen that this configuration of the edge tabs prevents the male panel 46 from moving in the direction of arrow 65. At the time same, the male 53 within the female 66 prevents the male panel 46 from sliding in a direction opposite to arrow 65. As a result, the two panels are firmly and securely locked together and, even when bottles are removed from the carton, the panels do not tend to move with respect to (i.e. move toward and away from) one another and, instead, stay securely and firmly locked together.

Figure 8:
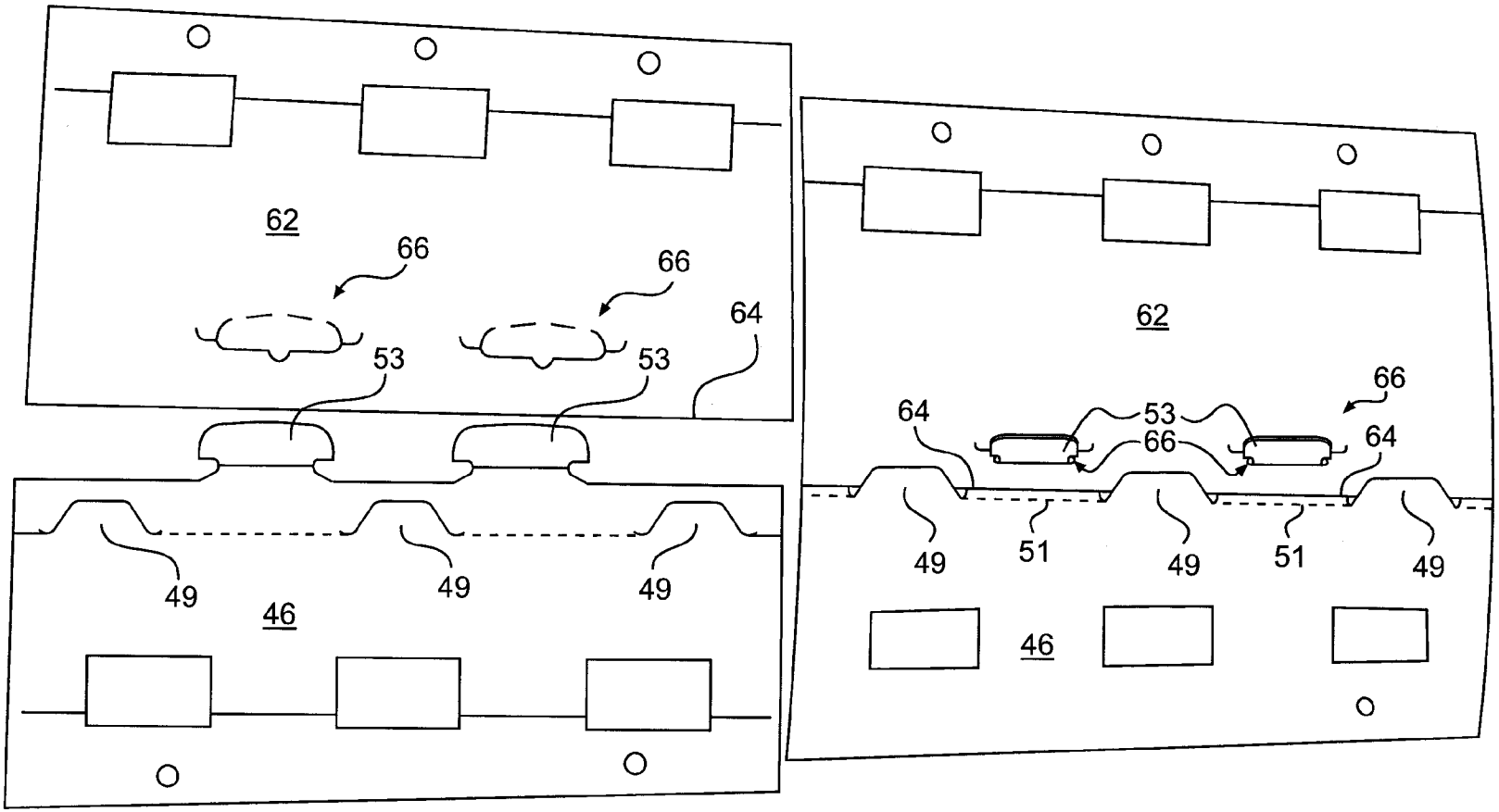
FIG. 8 illustrates the locking panels with the locking panels shown outside-up and separated on the left, and inside-up and interlocked on the right.

FIG. 8 illustrates the locking panels of this invention with the panels shown outside-up on the left in FIG. 8, and inside-up on the right. Key components are indicated on the right, and include the males 53, the females 66, the edge tabs 49, and the edge 64 of the female panel 62. The panels 62 and 46 are shown on the right in FIG. 8 as they appear from the inside when locked together according to the present disclosure. The edge tabs 49 are seen to be disposed beneath the edge 64 of the female panel 62 and, as detailed above, tend to prevent the panels 46, 62 from moving in a direction toward one another. The males 53 extend through the females 66 and are held in place by their shoulders 56 and the pressure of the females 66 bearing on the males 53. Thus, the males 53 and females 66 tend to lock the panels against movement away from one another. As a result, the panels are securely locked and are restrained against movement toward one another by the edge tabs 49 and are restrained against movement away from each other by the males 53 and females 66. The panels thus do not tend to disengage, even when one or more beverage bottles are removed from the carton during use.

Figure 9:
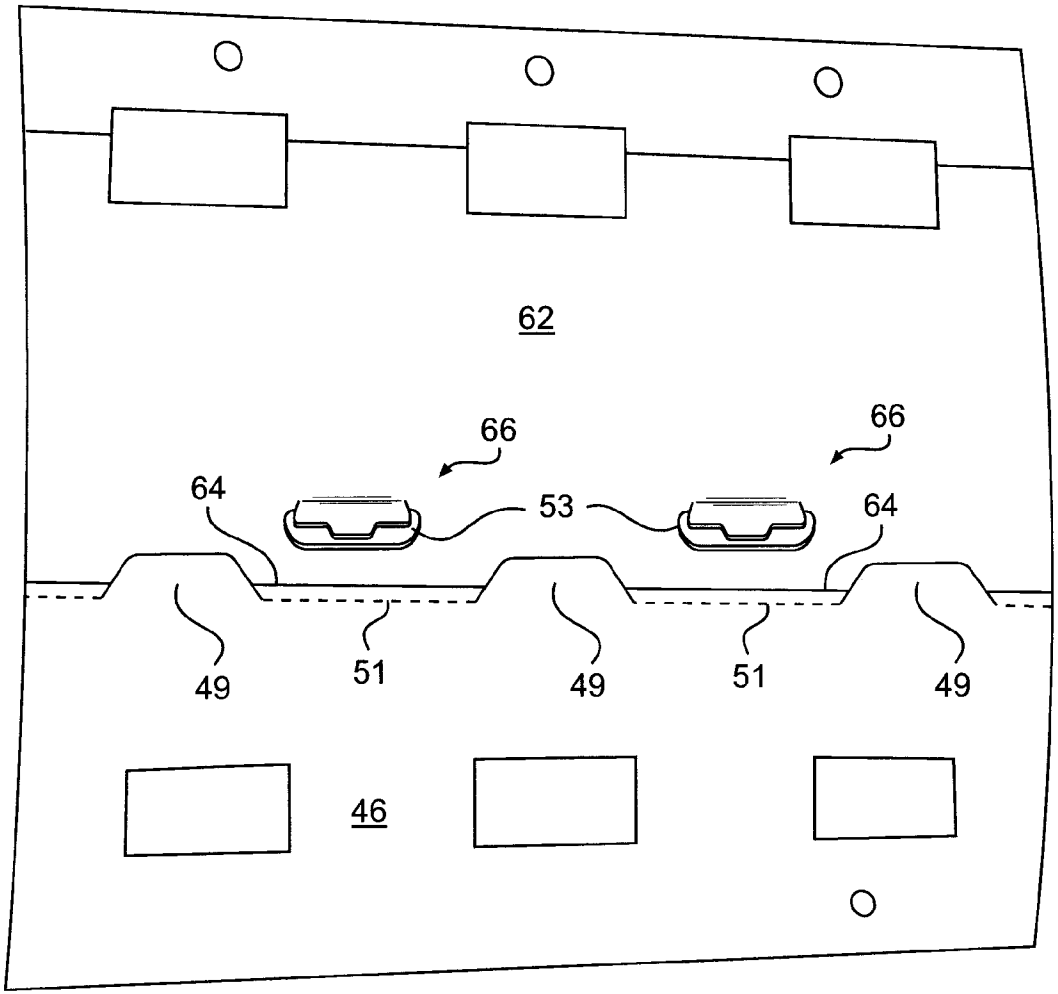
FIG. 9 is a close-up view showing the locking panels inside-up and interlocked.

FIG. 9 is a close-up view of the locked-together panels 62 and 46 showing the edge tabs 49 locked beneath the edge 64 and the male 53 locked within female 66. Again, the panels 46 and 62 are thereby locked securely together and restrained against movement either toward or away from each other, which holds the carton together securely during transport and as bottles are removed therefrom.

In addition to the forgoing advantages, the locking sections of this disclosure require slightly less paperboard than prior art locking sections, which can amount to significant savings when producing very large numbers of cartons.

The invention has been described herein in terms of preferred embodiments and methodologies considered by the inventors to represent the best mode of carrying out the invention. It will be obvious to those skilled in the art, however, that additions, deletions, and modifications may be made to the illustrated embodiments within the spirit and scope of the invention. For example, the males 53 and females 66 may take on configurations other than those illustrated in the above disclosure, as may the edge tabs 49. More or fewer edge tabs 49 and more or fewer males and females than illustrated in the preferred embodiments may be selected. These and other additions, deletions and modifications might well be made by skilled artisans without departing from the spirit and scope of the invention, which is bounded only by the claims. Such modifications should be construed to fall within the scope of the present invention.

What is claimed is:

1. A carton for holding containers, the carton comprising:

a first side panel;

a second side panel;

a first bottom panel foldably connected to the first side panel, the first bottom panel comprising at least one male locking member protruding from an edge of the first bottom panel, and at least one tab positioned inboard of the at least one male locking member; and a second bottom panel foldably connected to the second side panel, the second side panel comprising at least one female locking member, wherein the at least one female locking member is configured to receive and interlock with the at least one male locking member, and the at least one tab is configured to engage an outer free edge of the second bottom panel, wherein the outer free edge extends across the entire width of the bottom panel.

2. The carton of claim 1, wherein the at least one tab is defined by inboard cut lines and fold lines in the first bottom panel.

3. The carton of claim 2, wherein the first bottom panel comprises a locking panel section extending outboard from the inboard cut lines and fold lines, and wherein the at least one male locking member extends from the locking panel section.

4. The carton of claim 1, wherein the at least one tab comprises three tabs spaced apart along a width of the first bottom panel.

5. The carton of claim 4, wherein the at least one male locking member comprises two male locking members spaced apart along a width of the first bottom panel and the at least one female locking member comprises two female locking members spaced apart along a width of the second bottom panel.

6. The carton of claim 5, wherein the male locking members are offset from the tabs along the width of the first bottom panel.

7. The carton of claim 1, wherein the at least one tab remains substantially coextensive with the first bottom panel and projects towards the second bottom panel when the at least one tab engages the outer free edge of the second bottom panel.

8. The carton of claim 1, wherein the at least one female locking member is at least partially defined by a cut line in the second bottom panel, and wherein the at least one male locking member is configured to be inserted through the cut line.

9. The carton of claim 8, wherein the at least one male locking member comprises shoulders configured to engage the second bottom panel on opposing sides of the at least one female locking member.

10. The carton of claim 8, wherein the at least one female locking member is partially defined by a fold line in the second bottom panel and is configured to pivot about the fold line in the second bottom panel.

11. The carton of claim 10, wherein the at least one female locking member is configured to bear against the at least one male locking member to retain the at least one male locking member in a locked position.

12. The carton of claim 1, wherein the first bottom panel and the second bottom panel comprise openings configured to receive bottoms of containers.

13. The carton of claim 1, wherein, when the at least one female locking member is interlocked with the at least one male locking member and the at least one tab engages the outer free edge of the second bottom panel, the first bottom panel and the second bottom panel are locked together such that the first bottom panel is prevented from sliding towards the second bottom panel.

14. The carton of claim 1, wherein the at least one male locking element is configured to overlap the second bottom panel.

15. The carton of claim 1 wherein the first bottom panel comprises a locking panel section foldably connected to a remainder section, the locking panel section comprising the at least one male locking member, and the at least one tab extending from the remainder section, and wherein the at least one tab is generally in the same plane as the remainder section when the at least one tab engages the outer free edge of the second bottom panel.

16. The carton of claim 1 wherein the at least one tab extends toward the at least one male locking member.

17. The carton of claim 1 wherein the first bottom panel comprises a locking panel section foldably connected to a remainder section, the locking panel section comprising the at least one male locking member, and the at least one tab is separable from the locking panel section along at least one cut line.

18. The carton of claim 1 wherein the outer free edge is a first edge that extends between second and third edges of the bottom panel.

19. The carton of claim 18 wherein the first edge is generally perpendicular to the second and third edges.

20. A method for closing a bottom of a carton, comprising:

obtaining a first bottom panel comprising at least one male locking member protruding from an edge of the first bottom panel, and at least one tab positioned inboard of the at least one male locking member;

obtaining a second bottom panel comprising at least one female locking member;

moving an edge of the first bottom panel towards an outer free edge of the second bottom panel;

inserting at least one male locking member into the at least one female locking member and interlocking the at least one female locking member with the at least one male locking member; and positioning the at least one tab to engage the outer free edge of the second bottom panel, wherein the outer free edge extends across the entire width of the bottom panel.

21. The method of claim 20, wherein the at least one tab is defined by inboard cut lines and fold lines in the first bottom panel.

22. The method of claim 21, wherein the first bottom panel comprises a locking panel section extending outboard from the inboard cut lines and fold lines, and wherein the at least one male locking member extends from the locking panel section.

23. The method of claim 22, comprising:

folding the locking panel section away from the at least one tab prior to positioning the at least one tab to engage the outer free edge of the second bottom panel; and folding the locking panel section over the second bottom panel prior to inserting at least one male locking member into the at least one female locking member.

24. The method of claim 20, wherein the at least one tab comprises three tabs spaced apart along a width of the first bottom panel.

25. The method of claim 24, wherein the at least one male locking member comprises two male locking members spaced apart along a width of the first bottom panel and the at least one female locking member comprises two female locking members spaced apart along a width of the second bottom panel.

26. The method of claim 25, wherein the male locking members are offset from the tabs along the width of the first bottom panel.

27. The method of claim 20, wherein positioning the at least one tab to engage the outer free edge of the second bottom panel comprises positioning the at least one tab to remain substantially coextensive with the first bottom panel and project towards the second bottom panel.

28. The method of claim 20, wherein the at least one female locking member is at least partially defined by a cut line in the second bottom panel, and wherein inserting the at least one male locking member into the at least one female locking member comprises inserting the at least one male locking member through the cut line.

29. The method of claim 28, wherein inserting the at least one male locking member into the at least one female locking member comprises engaging shoulders of the at least one male locking member with the second bottom panel on opposing sides of the at least one female locking member.

30. The method of claim 28, wherein the at least one female locking member is partially defined by a fold line in the second bottom panel, and wherein inserting the at least one male locking member into the at least one female locking member comprises pivoting the at least one female locking member about the fold line in the second bottom panel.

31. The method of claim 30, wherein the at least one female locking member is configured to bear against the at least one male locking member to retain the at least one male locking member in a locked position.

32. The method of claim 20, comprising placing bottoms of containers in openings in the first and second bottom panels.

33. The method of claim 20, wherein, upon interlocking the at least one female locking member with the at least one male locking member and positioning the at least one tab to engage the outer free edge of the second bottom panel, the first bottom panel and the second bottom panel are locked together such that the first bottom panel is prevented from sliding towards the second bottom panel.

34. The method of claim 20 wherein the first bottom panel comprises a locking panel section foldably connected to a remainder section, the locking panel section comprising the at least one male locking member, and the at least one tab extending from the remainder section, and wherein the at least one tab is generally in the same plane as the remainder section when the at least one tab engages the outer free edge of the second bottom panel.

35. The method of claim 20 wherein the at least one tab extends toward the at least one male locking member.

36. The method of claim 20 wherein:

the first bottom panel comprises a locking panel section foldably connected to a remainder section, the locking panel section comprising the at least one male locking member;

the at least one tab is separable from the locking panel section along at least one cut line; and the method further comprises folding the locking panel section relative to the remainder section prior to positioning the at least one tab to engage the outer free edge of the second bottom panel, the folding the locking panel section at least partially separating the locking panel section and the at least one tab along the at least one cut line.

37. A carton configured to surround and contain objects, the carton comprising:

a first side panel and a second side panel;

a first bottom panel connected to the first side panel;

a second bottom panel connected to the second side panel;

first interlocking structures on the first and second bottom panels that, when interlocked, resist movement of the first and second bottom panels away from each other; and second interlocking structures on the first and second bottom panels that, when interlocked, resist movement of the first and second bottom panels toward each other;

at least a portion of the second interlocking structures engaging an outer free edge of the second bottom panel, wherein the outer free edge extends across the entire width of the bottom panel.

38. The carton of claim 37 wherein the first interlocking structures comprise a male structure on the first bottom panel and a female structure on the second bottom panel configured to receive and interlock the male structure.

39. The carton of claim 38 wherein the second interlocking structures comprise a tab on the first bottom panel configured to hook over the edge of the second bottom panel when the panels are brought together.

* * * * *